US010900216B2

(12) United States Patent
Thøgersen

(10) Patent No.: US 10,900,216 B2
(45) Date of Patent: Jan. 26, 2021

(54) SUPPORTING STRUCTURE FOR A WALL OR ROOF PARTITION

(71) Applicant: LABS Holding ApS, København S (DK)

(72) Inventor: Lars Thøgersen, København S (DK)

(73) Assignee: LABS Holding ApS, København S (DK)

( * ) Notice: Subject to any disclaimer, the term of this patent is extended or adjusted under 35 U.S.C. 154(b) by 0 days.

(21) Appl. No.: 16/481,144

(22) PCT Filed: Jan. 26, 2018

(86) PCT No.: PCT/EP2018/051963
§ 371 (c)(1),
(2) Date: Jul. 26, 2019

(87) PCT Pub. No.: WO2018/138265
PCT Pub. Date: Aug. 2, 2018

(65) Prior Publication Data

US 2019/0360191 A1 Nov. 28, 2019

(30) Foreign Application Priority Data

Jan. 27, 2017 (EP) ..... 17153598

(51) Int. Cl.
*E04B 1/26* (2006.01)
*E04B 1/343* (2006.01)
(Continued)

(52) U.S. Cl.
CPC ..... *E04B 1/26* (2013.01); *E04B 1/34326* (2013.01); *E04B 7/045* (2013.01); *E04C 3/292* (2013.01);
(Continued)

(58) Field of Classification Search
CPC ..... E04B 1/26; E04B 1/34326; E04B 7/045; E04B 2001/2616; E04B 2001/2648;
(Continued)

(56) References Cited

U.S. PATENT DOCUMENTS 5,564,234 A * 10/1996 Vermeulen ..... A01G 9/242 52/63
6,487,821 B1 * 12/2002 Thomsen ..... E04B 7/163 52/90.1
(Continued)

FOREIGN PATENT DOCUMENTS

CH 673305 A5 2/1990
DE 3942234 7/1991
(Continued)

*Primary Examiner* — Rodney Mintz
(74) *Attorney, Agent, or Firm* — McHale & Slavin, P.A.

(57) ABSTRACT

A supporting structure (102) for a wall or a roof partition (104; 120) of a building structure (100), comprises an internal core structure (114) extending in a longitudinal direction, and first and second external covering profiles (106) for at least partially covering the core structure (114). The covering profiles (106) define inwardly and outwardly facing surfaces (108) facing one another, with slits (116) being formed at the inwardly facing surfaces (108). The core structure comprises at least two bands of material (114) which are mutually offset. The supporting structure (102) is suitable as a post, pillar, column, lath, batten, rafter, truss, girder, bar, or beam for a wall or roof partitions of a greenhouse, a cabin or shanty, a wall of a house, a stand-alone wall or roof partition, such as pent roof, a canopy, a fence, a windbreak or a solar panel structure The bands of material (114) are interconnected at their ends only and are pre-tensioned to provide stiffness, and may be configured to minimize their thermal conductivity.

19 Claims, 10 Drawing Sheets

(51) Int. Cl.
*E04B 7/04* (2006.01)
*E04C 3/292* (2006.01)
*E04B 1/35* (2006.01)

(52) U.S. Cl.
CPC ..... *E04B 2001/2616* (2013.01); *E04B 2001/2648* (2013.01); *E04B 2001/2676* (2013.01); *E04B 2001/2692* (2013.01); *E04B 2001/3583* (2013.01)

(58) Field of Classification Search
CPC ..... E04B 2001/2676; E04B 2001/2692; E04B 2001/2696; E04B 2001/3583; E04C 3/292; E04C 3/29; E04C 3/32; E04C 3/18; E04H 1/1205; E04H 17/20
See application file for complete search history.

(56) References Cited

U.S. PATENT DOCUMENTS 7,568,307 B1 * 8/2009 Zimhoni ..... A01G 9/241 47/17
8,505,246 B1 * 8/2013 Cadorath ..... E04B 7/163 52/79.6
9,642,315 B2 * 5/2017 Lloyd ..... A01G 9/1407
10,246,876 B2 * 4/2019 Brean ..... E04B 7/163
10,251,346 B2 * 4/2019 Lloyd ..... A01G 9/16
10,407,912 B1 * 9/2019 White ..... E04B 7/163
2008/0277551 A1 11/2008 Hackney
2009/0151282 A1 6/2009 Loayza
2009/0183425 A1 * 7/2009 Zimhoni ..... A01G 9/14 47/17
2018/0334801 A1 * 11/2018 Brean ..... E04B 7/045

FOREIGN PATENT DOCUMENTS

| | | | |
|---|---|---|---|
| DE | 202015106882 | | 1/2016 |
| FR | 2718473 | | 10/1995 |
| GB | 561589 | A | 5/1944 |
| GB | 969843 | | 9/1964 |
| JP | H1181469 | A | 3/1999 |
| KR | 200448363 | Y1 | 4/2010 |
| WO | WO9850662 | | 11/1998 |
| WO | WO2018138265 | | 8/2018 |

* cited by examiner

SUPPORTING STRUCTURE FOR A WALL OR ROOF PARTITION

CROSS REFERENCE TO RELATED APPLICATIONS

This is a national stage filing in accordance with 35 U.S.C. § 371 of PCT/EP2018/051963, filed Jan. 26, 2018, which claims the benefit of the priority of European Patent Application No. 17153598.2, filed Jan. 27, 2017, the contents of each are incorporated herein by reference.

TECHNICAL FIELD

The present invention relates to a supporting structure for supporting a wall or a roof partition. The wall partition or roof partition may form part of a building structure, such as a greenhouse, a cabin or shanty, or a wall of a house, or it may form part of a stand-alone wall or roof partition, such as pent roof, a canopy, a fence, a windbreak or the like. The supporting structure may be in the form of a post, pillar, column, lath, batten, rafter, truss, girder, bar, beam or the like. It may have a load-bearing capability, but need not have so.

BACKGROUND OF THE INVENTION

The prevailing aim and function of supporting structures of the above types is to bring about the intended support, such as to provide the required stiffness or load-bearing capability. For outdoor applications, weather-resistance is normally prerequisite. Thus, supporting structures for greenhouses, cabins, walls, fences, roofs, etc. are typically made from a stiff, non-corrosive metallic material, such as stainless steel, galvanized steel, or a coated metallic material. Whilst such materials fulfil the intended functions of the supporting structure, tooling thereof for mounting of, e.g., window, roof or solar panel partitions is often difficult.

For self-assembly structures, such as fences or greenhouses, metallic support structures normally require pre-tooling, for example provision of holes for receiving screws, studs or rivets, as users cannot be expected have the ability to correctly provide such holes or otherwise tool the elements at the intended and sufficiently precise positions. Moreover, despite of available standard cross-sections and dimensions for supporting structures, which can be mass-manufactured at relatively low cost, their supporting and possibly also load-bearing requirements imply quality demands in respect of material properties and manufacturing which compromise the general desire for keeping costs at a minimum. The high density of metallic materials additionally increases costs related to transportation and other handling. Further, though metallic supporting structures may have adequate structural properties in terms of their stiffness and strength, they are also excellent heat conductors; a property which runs counter to the need for thermal insulation of, e.g., wall or roof partitions of building structures. Finally, for applications in which metallic supporting structures are visible, they often tend to aesthetically impair the overall appearance of the building structure, of which they form part, such as of a greenhouse.

DE 39 42 234 discloses a post comprising a metallic core and a cover made from wood or plastics. The metallic core may be rectangular, tubular or solid. Even though the post of this prior art disclosure reduces the amount of metallic material used as compared to an identically dimensioned post made entirely from metal, embodiments of the post may still suffer from disadvantages in relation to its ability to accommodate or support a wall or window partition, and its thermal conductivity. Moreover, the post of DE 39 42 234 may be difficult to assemble to other elements, such as a like post or a wall or roof partition.

WO 98/50662 discloses a method for making an element such as a liner section consisting of a wood-metal combination, wherein the wooden parts are first heated at a high temperature previous to being fixed on the metal portion external surface. The structure of WO 98/50662 may be difficult to assemble to other elements, and it is unsuitable for accommodating a wall, roof or window partition.

SUMMARY OF THE INVENTION

On the above background, it is an object of embodiments of the invention to provide a supporting structure which has sufficient and improved stiffness and/or strength to meet the requirements of various uses. It is a further object of embodiments of the invention to provide a supporting structure which can be easily assembled with other like structures and/or wall or roof partitions. It is a further object of embodiments of the invention to provide a supporting structure which allows for easy and convenient assembly with a like supporting structure. It is a further object of embodiments of the invention to provide a supporting structure which is useful for various purposes and applications, such as a post, pillar, column, lath, batten, rafter, truss, girder, bar, beam or the like, for various applications such as greenhouses, cabins or shanties, walls of houses or other buildings, stand-alone walls or stand-alone roof partitions, as pent roofs, canopies, fences, windbreak and the like. It is a further object of embodiments of the invention to provide a supporting structure which minimizes thermal conductivity. It is a further object of embodiments of the invention to provide a supporting structure which has excellent stiffness properties and which yet can be manufactured at low cost. It is a further object of embodiments of the invention to minimize the use of wood or other materials covering the load-bearing parts of the supporting structure and to provide a system, of which identical parts, including identical pre-tensioning elements, can be used for making posts, pillars, columns, laths, battens, rafters, trusses, girders, bars, beams, etc. It is a further object of embodiments of the invention to provide a supporting structure which has an appealing aesthetic appearance, and/or the visual appearance of which can be easily adopted to a specific use.

The present invention provides a supporting structure for a wall or a roof partition, comprising:

- an internal core structure extending in a longitudinal direction;
- first and second external covering profiles extending in the longitudinal direction for at least partially covering the core structure, each of the first and second covering profiles defining inwardly facing surfaces facing one another;

wherein

- the core structure extends between and engages into respective slits in the inwardly facing surfaces of the covering profiles;
- the core structure comprises at least two bands of material which are mutually offset in a direction perpendicular to the longitudinal direction, wherein each of the bands of material defines respective end portions at its opposite ends when seen in the longitudinal direction;
- the at least two bands of material are interconnected only at their end portions;

the supporting structure further comprises bracket structures for pre-tensioning the bands in the longitudinal direction, the bracket structures attaching to the opposite ends of each of the bands of material and interconnecting the at least two bands of material;

each one of the bracket structures extends beyond the respective end portions of the bands of material in the longitudinal direction.

The bands of material thereby confer sufficient and improved stiffness to the support structure whilst having a comparatively low extent in the cross-section of the supporting structure. Thus, whereas the core structure may preferably be made from a first material having relatively high stiffness or strength, the covering profiles may advantageously be made from another second material having relative low stiffness or strength. For example, the bands of material may typically be made from a first metallic material, such a steel, such as more specifically stainless or galvanized steel, or from reinforced plastics, whereas the covering profiles may be made from another material, such as a second metallic material less costly than the first metallic material, wood, plastics, etc. The material from which the covering profiles are made may have mechanical properties and/or a visual appearance different from that of the core structure. Moreover, due to the interconnection of the two bands of material at their end portions only, transversely extending cross elements along the length of the bands are avoided, without compromising unidirectional strength. Yet, the bands can be conveniently accommodated in slits in the covering profiles to keep manufacturing costs at a minimum and to safeguard ease of assembly. According to the invention, the interconnection of the bands at their ends is effected by the bracket structures, which have a dual function of (1) interconnecting and thus mutually securing the bands, and (2) imparting a tensioning force in the longitudinal direction to the bands to thereby pretension them. In order to provide convenient access to the bracket structures for assembly and disassembly purposes, notably access by tools and/or fingers of an assembly technician, the bracket structures extend beyond the end portions of the bands of material. The covering profiles and/or parts of a building structure, into which the supporting structure of the invention may be integrated, may form suitable abutment surface for engagement by the bracket structures to provide the required counterforce when the bracket structure imparts the pre-tensioning force to the bands of material.

Thanks to the extension of the bands of material into slits in the inwardly facing surfaces of the covering profiles, the bands and slits may conveniently serve to correctly position the covering profiles relative to one another.

Inherent to the structure of bands, each of them extends by a first dimension in one direction, when seen in a cross section perpendicular to the longitudinal direction, and by a second dimension in a second direction, which is perpendicular to the first direction, wherein the second dimension is smaller than the first dimension. The ratio of the first dimension to the second dimension is preferably at least three, such as at least five, at least 10, at least 15 or 20 or more. Preferably, the second dimension is parallel to the wall or roof partition supported by the supporting structure, whereas the first dimension may be transverse, notably perpendicular thereto. Thus, given that the area of the bands facing inwardly and outwardly is relatively small, the heat insulating properties of the supporting structure may be improved, in particular in respect of embodiments, in which the heat conductivity of the bands is higher than the heat conductivity of the covering profiles.

In order to further increase thermal insulation, the bands of material may be made from a non-metallic material or from a composite including a non-metallic component. For example, the bands of material may be made from glass- or steel-fiber reinforced plastics. The bands of material may thus have a thermal conductivity of at most 5 W/mK (2.89 ft/hr/ft$^2$/° F.), such as 3 W/mK (1.73 ft/hr/ft$^2$/° F.), at most 2 W/mK (1.16 ft/hr/ft$^2$/° F.), such as 1 W/mK (0.58 ft/hr/ft$^2$/° F.), or at most 0.5 W/mK (0.29 ft/hr/ft$^2$/° F.), at 20° C. (68° F.)

The bands of material are advantageously pre-tensioned in order to increase their stiffness and thus the stiffness of the support when assembled, or they may be arranged in a way that allows tensioning thereof during assembly of the supporting structure and its associated roof or wall partition. This allows for extension of the longitudinal extent of the supporting structure as well as of the wall or roof partition supported thereby, so as to avoid the need for cross bars interconnecting the supporting structures or to at least increase the distance between cross-bars and to thereby decrease their number.

Each of the bands preferably consists of a solid piece of material, rather than from a hollow profile. The piece of material may have the required stiffness inherent to it, i.e. without need for pre-tensioning thereof, or it may be pre-tensioned or arranged for tensioning thereof during assembly of the supporting structure and the associated roof or wall partition.

Each of the covering profiles preferably defines left and right side surfaces. In one structural configuration, the inwardly facing surfaces of the covering profiles may define a gap for accommodation of a wall or roof partition there between. For example, the first and second covering profiles or at least their inwardly facing surfaces may be mutually offset in a first direction perpendicular to the longitudinal direction. Preferably, in embodiments, in which each of the covering profiles comprises two opposing covering profiles, the left and right side surfaces of opposing ones of the covering profiles lie flush with one another when seen in a cross section perpendicular to the longitudinal direction. In other words, the left side surface of a first one of the covering profiles lies flush with a left side surface of a second one of the covering profiles, and the right side surface of the first one of the covering profiles lies flush with a right side surface of the second one of the covering profiles. A first one of the bands of material may be at a first lateral distance from the right side surface, and a second one of the bands of material may be at a second lateral distance from the left side surface. In order to ensure a stabilizing overlap between the wall or roof partition supported by the supporting structure and the inwardly facing surfaces of the covering profiles, the gap preferably has a width in the first perpendicular direction which is equal to or smaller than each of the first and second lateral distances.

In order to keep the covering profiles and the core structure in their intended mutual position and to secure the wall or roof partition relative to the supporting structure, the supporting structure may comprise a biasing structure for biasing the first and second covering profiles towards one another.

At at least one end of the bands of material, the bands are by means of a cross element forming part of the bracket structure. Such cross element may contribute to maintaining the bands in their intended mutual position, and may further facilitate attachment of an external structure thereto, such as a connecting element for connecting the supporting structure to a like supporting structure.

The present invention further provides a building structure comprising a wall or roof partition and at least one supporting structure according as claimed and disclosed herein for supporting the wall or roof partition. The wall or roof partition may comprise a window or roof glass, a solar panel, a wooden panel, a plastics or plastics-composite panel, or any other type of partition depending on the intended application of use.

The building structure of the present invention may comprise at least two such supporting structures according to the invention. A connecting element of the bracket structure may attach to at least one of the bands of each of the supporting structures. Preferably, the bracket structure attaches to the bands of each of the supporting structures. Thus, like supporting structures may be used for the modular build-up of walls and/or roofs, with identical supporting structures being used for upright posts for supporting wall partitions as well as for rafters, trusses, laths or battens for supporting roof partitions. In one embodiment of the building structure, the longitudinal direction of a first one of the supporting structures may extend at an angle relative to the longitudinal direction of a second one of the supporting structures, the angle being defined by the bracket structure. The angle defined by the bracket structure may be variable, in case the bracket structure allows the angle to be set by a user, or fixed. Thus, the bracket structure may facilitate correct interconnection and positioning of two supporting structures which are to extend at an angle relative to each other.

In order to attach the bracket structure to the respective core structures of the supporting structures, the bracket structure may attach to respective cross elements of each of the supporting structures, the cross elements interconnecting the bands of the core structures.

Embodiments of the building structure may comprise at least three supporting structures, a first one of which extends transversely to the other two, and wherein the bracket structure attaching to the other two supporting structures extends through an opening formed in the bands of the first supporting structure. The modularity of the building structure may thereby be enhanced, whilst ease of manufacture and assembly is safeguarded.

In other embodiments of the building structure it may comprise at least three supporting structures, a first one of which extends transversely to the other two, and wherein the bracket structure is arranged in the vicinity of the ends of three of the supporting structures to provide a tensioning force to them in at least two directions. For example, at a T-joint between an upright post and a horizontal lath, the bracket structure may impart oppositely directed tensioning forces to the bands of the supporting structures extending away from the bracket in the horizontal direction, whilst the bracket structure at the same time may provide a vertically directed tensioning force to the bands of the supporting structure extending away from the bracket in the vertical direction. In another exemplary embodiment, a first one of the supporting structures extends in a vertical column of a wall partition of the building structure, whereby the longitudinal direction of the first supporting structure extends vertically, and the two other ones of the supporting structures extend in a roof partition of the building structure, whereby the longitudinal direction of said other ones of the supporting structure extends horizontally or at an acute angle relative to the vertical direction.

For building structures like cabins or greenhouses, the at least one supporting structure may comprises at least two supporting structures providing a ground-to-ground tensioning system extending from at least two ground attachment points through the at least two supporting structures. For example, the at least two supporting structures may comprise at least two upright supporting structures and at least one transversely extending supporting structure, and the bands of material of the at least two upright structures and the transversely extending structure may be pre-tensioned and mutually interconnected by the bracket structures. Stability of the building structure may thus be achieved in a simple and convenient manner.

In a most general independent aspect, the present invention provides a supporting element for a wall or a roof partition, comprising:

- an internal core structure extending in a longitudinal direction;
- first and second external covering profiles extending in the longitudinal direction for at least partially covering the core structure, each of the first and second covering profiles defining inwardly facing surfaces facing one another;

wherein

- the core structure extends between and engages into respective grooves in the inwardly facing surfaces of the covering profiles;
- and wherein the core structure comprises at least two bands of material which are mutually offset in a second direction perpendicular to the longitudinal direction.

In embodiments of such a general aspect of the invention, the bands of material may be pre-tensioned. Further features and functionalities of the embodiments of the invention as described above may be applied. In another general independent aspect, the present invention also provides a building structure comprising a wall or roof partition and at least one supporting element according as disclosed above.

BRIEF DESCRIPTION OF THE DRAWINGS

Embodiments of the invention will hereinafter be described with reference to the drawings, in which.

DETAILED DESCRIPTION OF THE DRAWINGS

Figure 1:
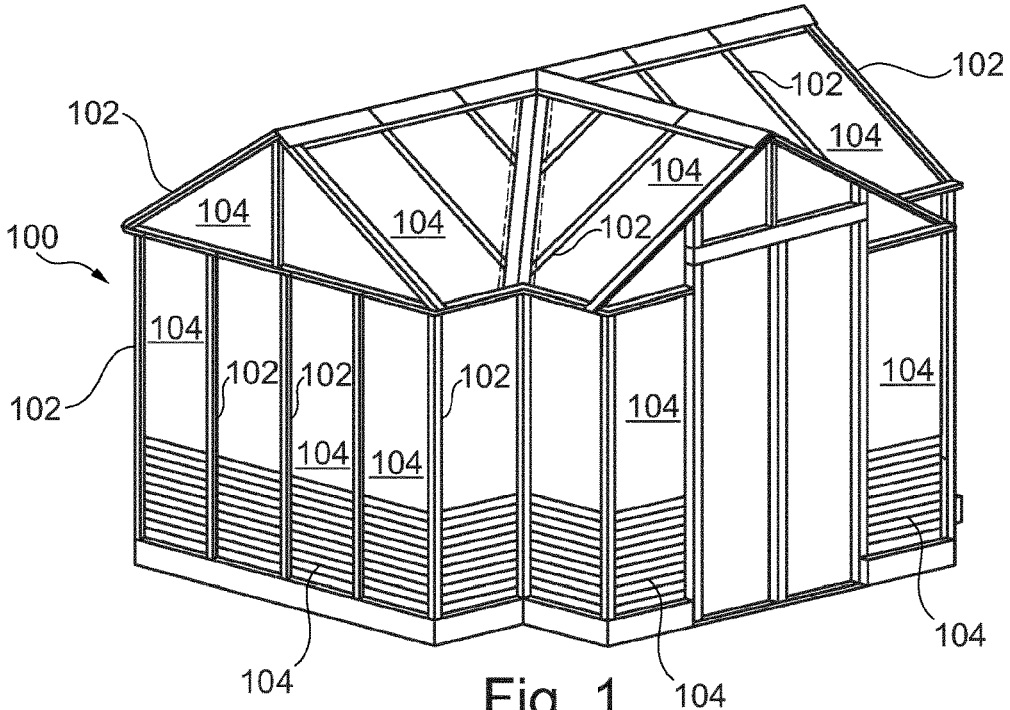
FIG. 1 shows an embodiment of a building structure according to the invention including a plurality of supporting structures of the invention.

To the extent the same reference numbers are used in multiple drawings herein, elements designated by such reference numbers may only be referred to once, it being understood that identical or equivalent elements having identical or equivalent functions are designated by the same reference numbers in the drawings.

The building structure 100 shown in FIG. 1 forms a greenhouse comprising a plurality of wall and roof partitions 104 supported by a plurality of supporting structures 102. The supporting structures are provided as upright posts, including corner posts for supporting the wall partitions, and as trusses and laths for supporting the roof partitions.

Figure 2:
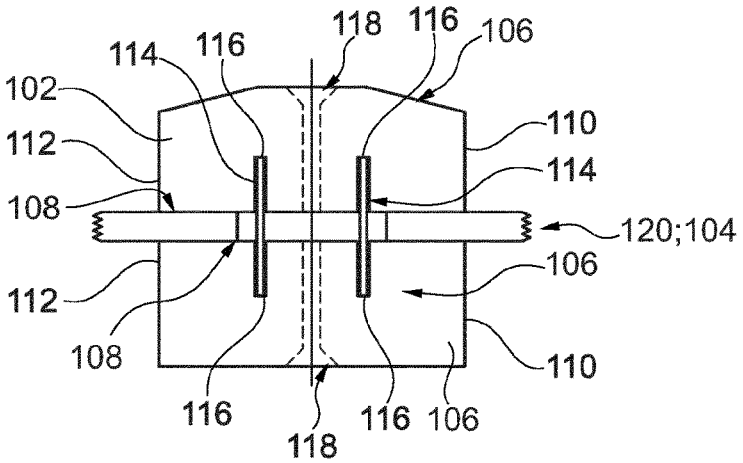
FIGS. 2 and 3 are cross-sections of embodiments of supporting structures according to the invention.
Figure 3:
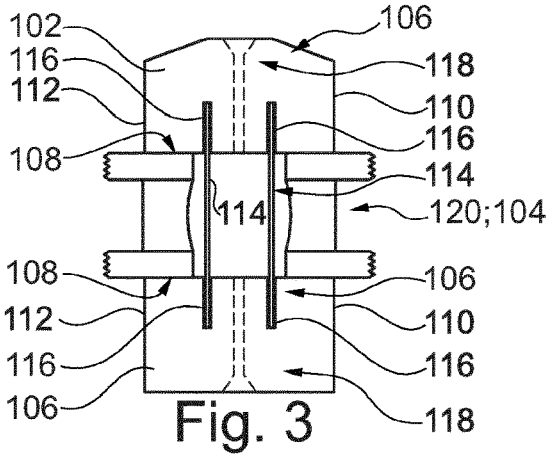

FIGS. 2 and 3 are cross-sections, in a cross-sectional view perpendicular to the longitudinal direction of the supporting structures 102, of embodiments of supporting structures 102 according to the invention. In each one of the embodiments, the supporting structure 102 comprises two covering profiles 106 of, e.g., a wooden material. Each of the covering profiles defines inwardly facing surfaces 108 facing each other as well as right side surfaces 110 and left side surfaces 112, each pair of right side surfaces 110 lying flush with one another, and each pair of left side surface lying flush with one another. A core structure is provided, the core structure comprising two bands of material 114 made from, e.g., a metallic material, plastics, or reinforced composite plastics. Each band of material 114 extends into a slit 116 formed in the covering profiles 106. A biasing structure in the form of a screw or bolt connection 118 is provided for securing the covering profiles 106 and bands of material 114 of the core structure in place. A wall or roof panel 104, which in the embodiment shown in FIGS. 2 and 3 is in the form of a window or solar panel, is held in place between the covering profiles 106 and abutted in overlapping manner by their inwardly facing surfaces 108. In the embodiment of FIG. 2, the partition 104,120 may, e.g., be in the form of a single-layer structure, such as a single-layer window glass, whereas in the embodiment of FIG. 3, the partition 104,120 is in the form of a multiple-layer structure, such as, e.g., a double-glazed window, see FIG. 20.

Figure 4:
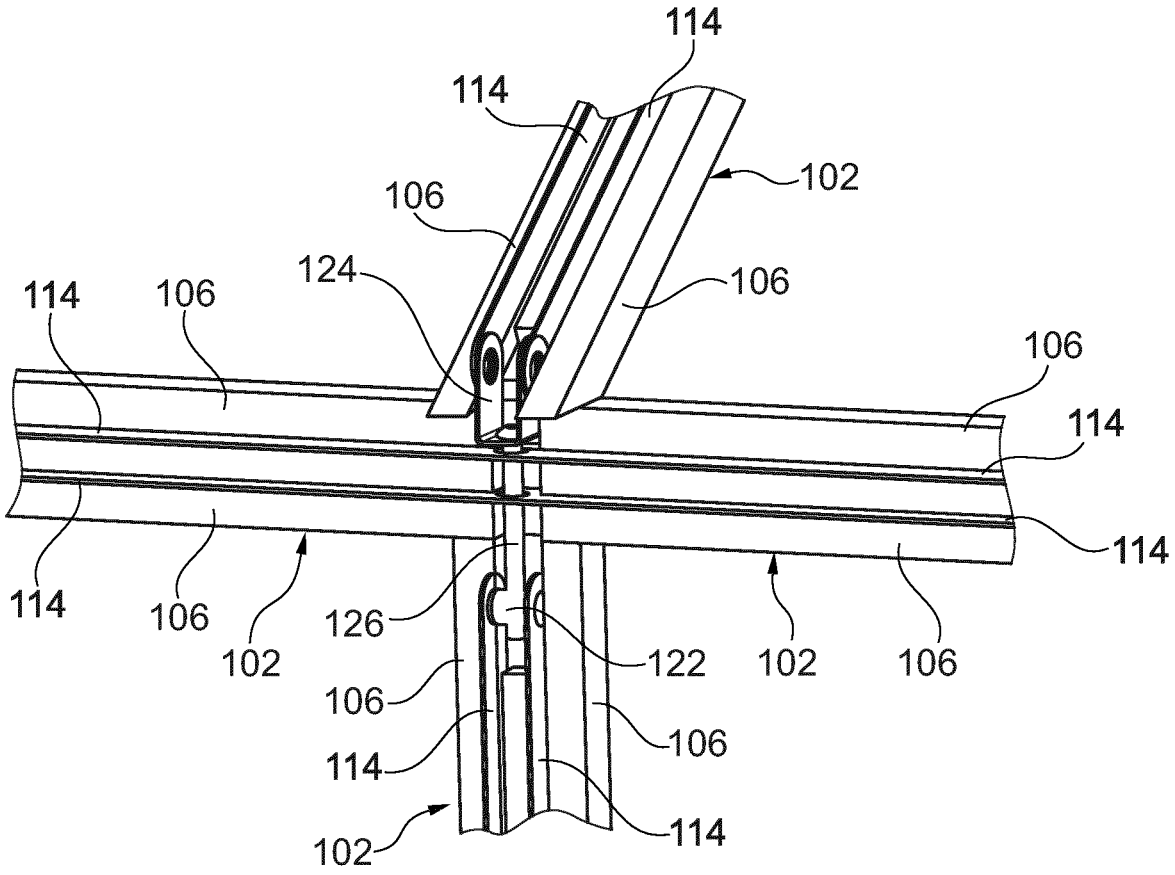
FIGS. 4 and 5 depict embodiments of interconnections between adjacent embodiments of supporting structures according to the invention.
Figure 5:
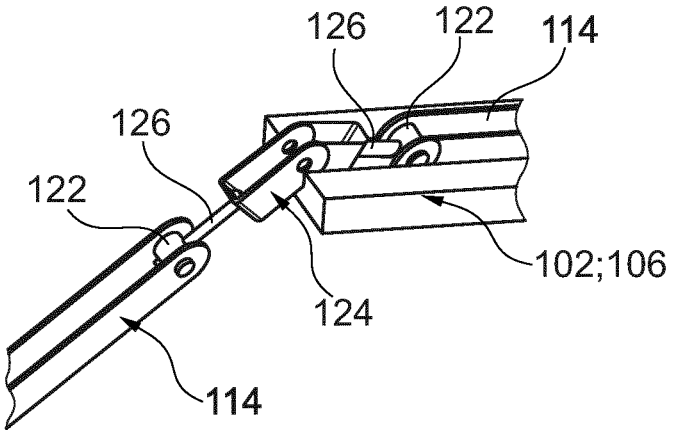

FIGS. 4 and 5 illustrate embodiments of interconnections between supporting structures 102. As shown, each pair of bands of material 114 of the core structure of the supporting structures 102 comprise at its ends a cross element 122 forming part of a bracket structure comprising a connecting pin or bolt 126 and a bracket 124. In the embodiment of FIG. 5, the bracket defines the angle between the two pairs of bands of material 114 and thus of the supporting structures 102, of which only one is shown in FIG. 5.

Figure 6:
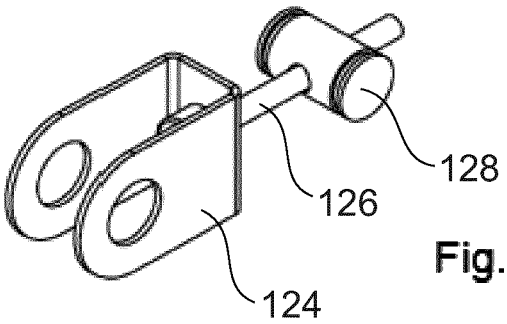
FIGS. 6-8 illustrate embodiments of bracket structures for interconnecting supporting structures according to the invention.
Figure 7:
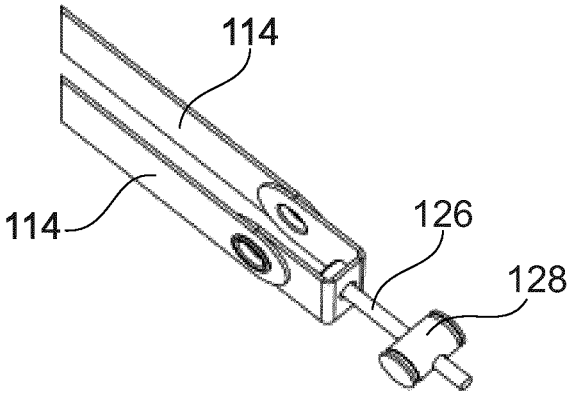

FIGS. 6 and 7 illustrate a first embodiment of a bracket structure comprising bracket 124, connecting pin or bolt 126, and a cylindrical element 128 for extending into and engaging corresponding holes in the pair of bands of material, as shown in FIG. 7.

Figure 8:
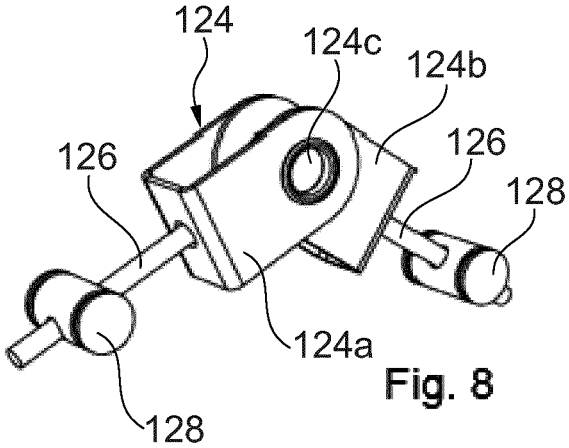

In the embodiment of the bracket structure shown in FIG. 8, the bracket 124 comprises two bracket parts, 124*a* and 124*b*, which are mutually secured at a variable or fixed angle at connecting part 124*c*. The angle defined between the bracket parts 124*a* and 124*b* thus defines the angle between the pairs of bands of material 114, into which the cylindrical parts 128 engage, and thus the angles between the associated supporting structures.

Figure 9:
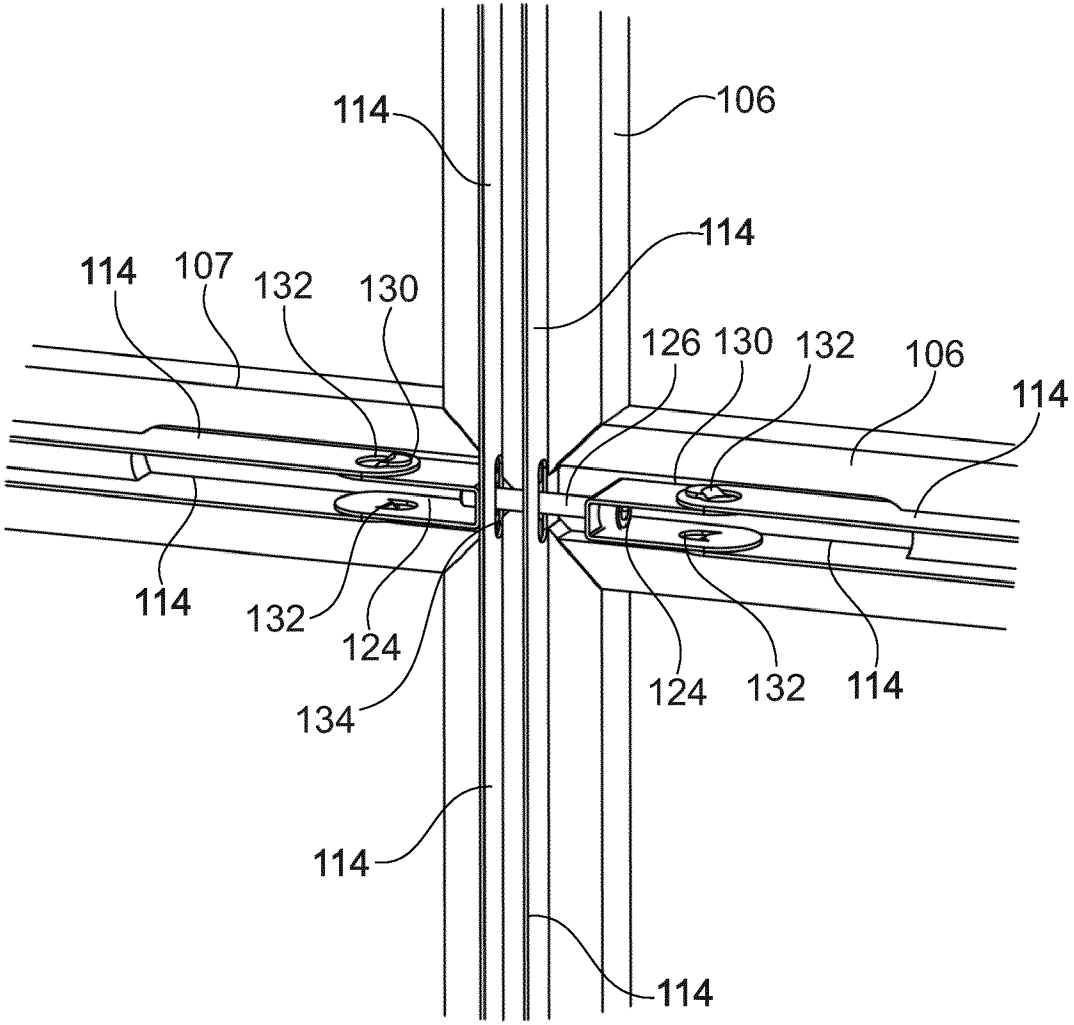
FIGS. 9-12 illustrate further embodiments of building structures according to the invention.

The exemplary embodiment of a building structure shown in FIG. 9 comprises three supporting structures, a first one of which extends vertically in an upright post of the building structure and the other two extend horizontally in a horizontal bar of the building structure. A bracket structure comprising bracket 124 and connecting pin or bolt 126 attach to the horizontally extending supporting structures, whereby the connecting pin or bolt of the bracket structure extends through an opening 134 formed in the bands of material 114 of the vertically extending supporting structure. Folded flaps 130 are formed integrally with the bracket 124 to engage an inner circumferential edge of openings 132 formed in the bands of material 114.

Figure 10:
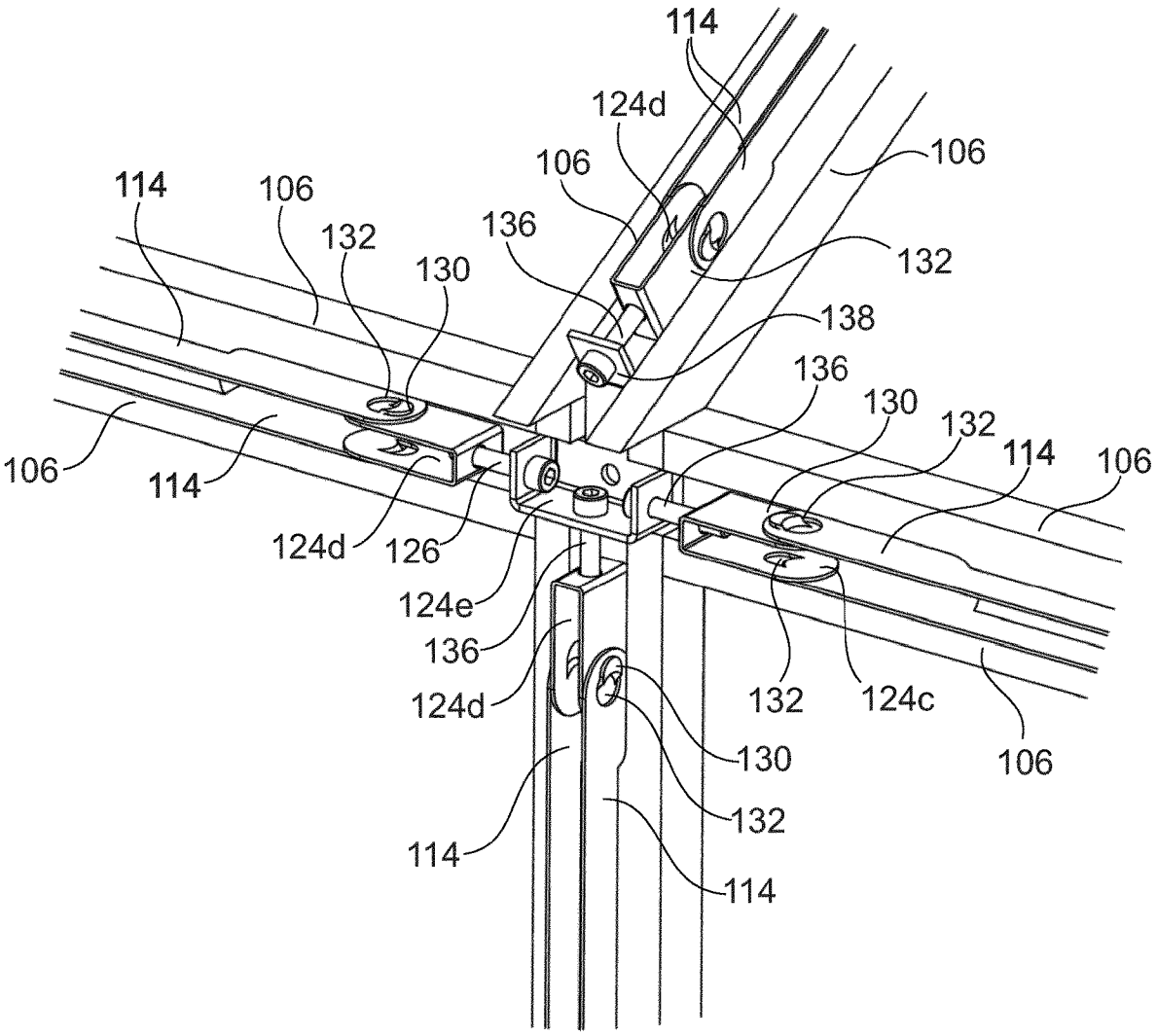

The embodiment of FIG. 10 comprises four supporting structures, a first one of which extends vertically in an upright post of the building structure, two extend horizontally in a horizontal bar of the building structure, and a fourth one extends upwardly at an inclined angle along a roof rafter. A U-shaped bracket 124*e* attaches to the bands of the vertically and horizontally extending supporting structures through tensioning bolt 136 and a further bracket 124*d*. For the rafter structure, the bracket 124*d* is likewise engaged by a bolt 136 attaching to a backing plate 138 integrally formed with the bracket 124*e*.

Figure 11:
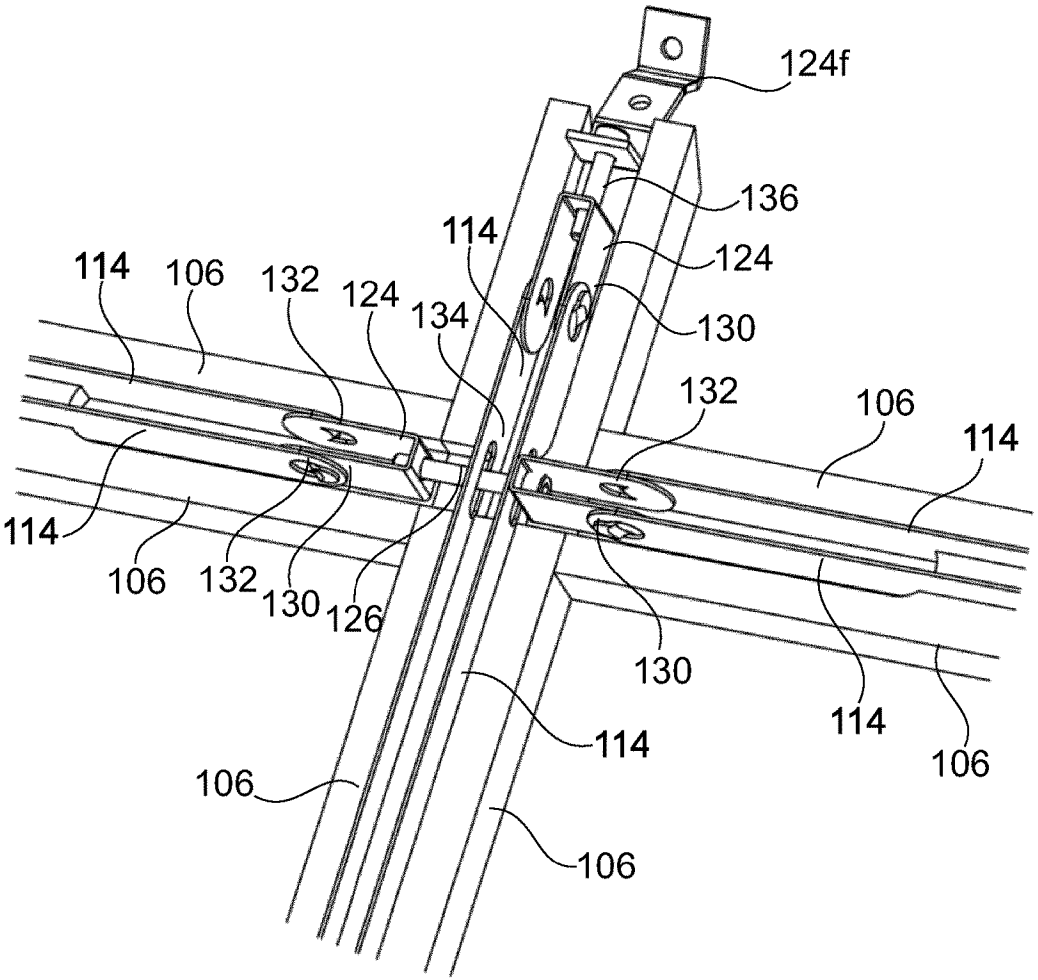
Figure 12:
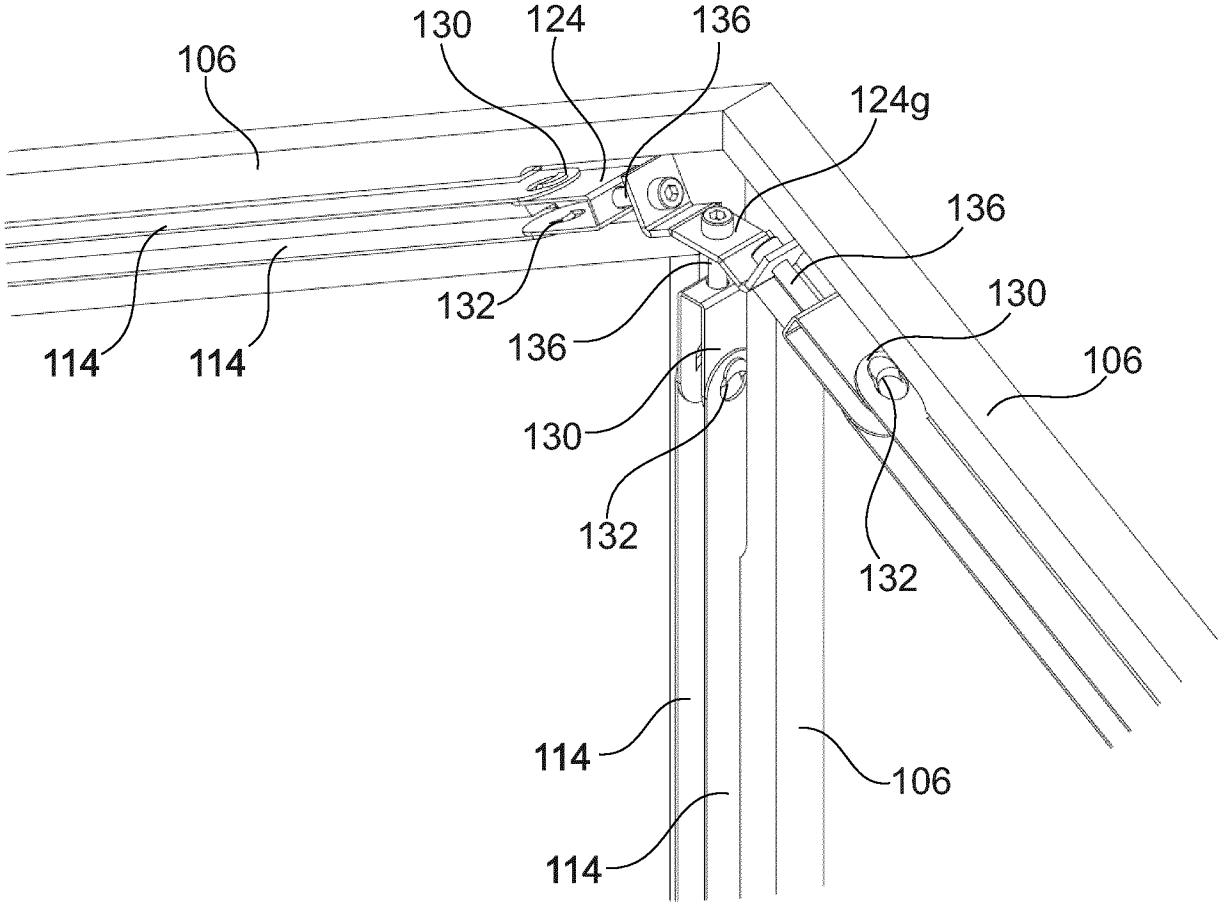
Figure 13:
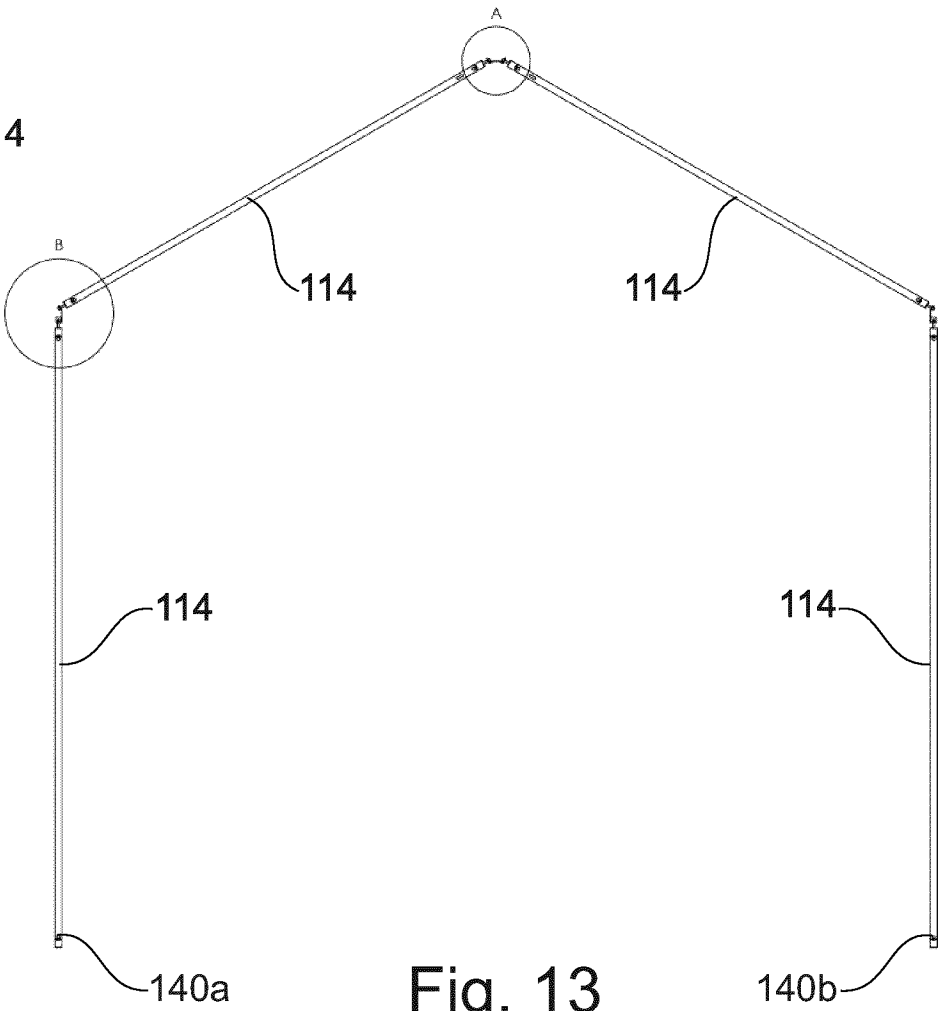
FIGS. 13-18 illustrate further embodiments of supporting structures according to the invention.
Figure 14:
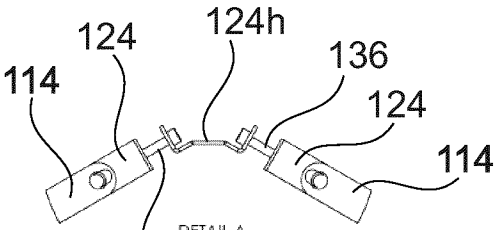
Figure 15:
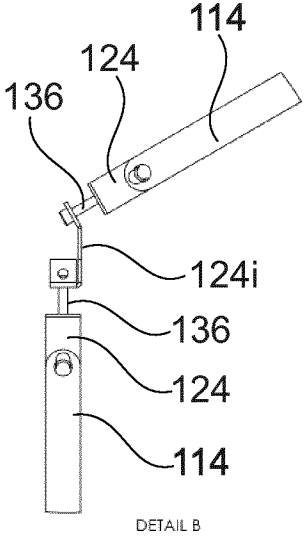
Figure 16:
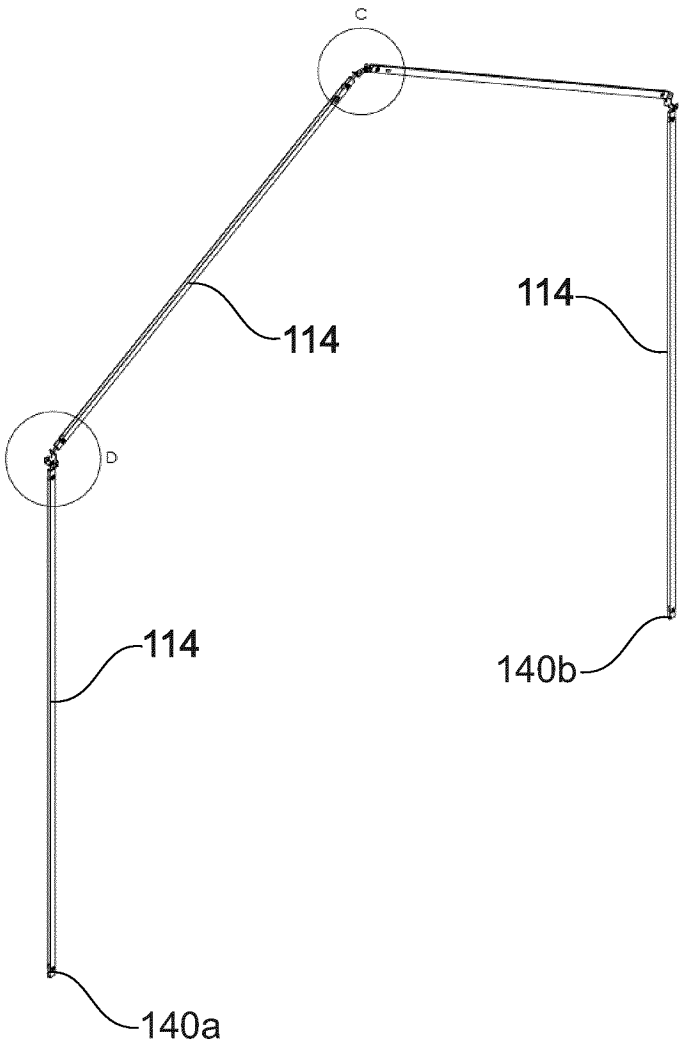
Figure 17:
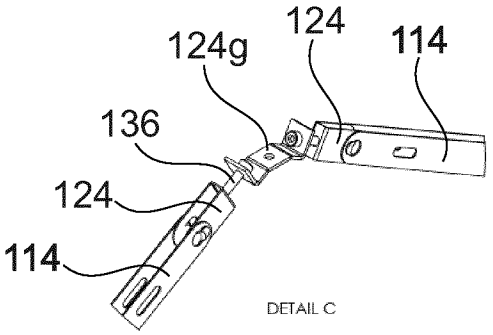
Figure 18:
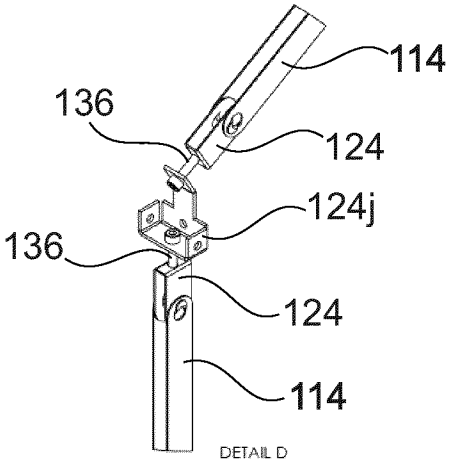

FIG. 11 illustrates an embodiment of a building structure comprising a rafter crossing a pair of lathes. The rafter extends upwardly at an inclined angle, and the lathes extend horizontally. Bracket structures comprising brackets 124 and connecting pin or bolt 126 attach to the supporting structures of the lathes, whereby the connecting pin or bolt of the bracket structure extends through opening 134 formed in the bands of material 114 of the supporting structure of the rafter. At the upper end of the rafter, bracket 124 attaches to an angled further bracket 124*f* through bolt 136 for connection to a supporting structure of a cross-bar of rafter (not shown). As shown in FIG. 12, a like bracket 124*g* may be employed at a junction between respective supporting structures of a vertically extending post and left and right rafters.

FIGS. 13-18 illustrate assembly systems of embodiments of supporting structures of the invention for providing a ground-to-ground tensioning system extending from ground attachment points 140*a* and 140*b* through vertically extending posts as well as rafters to provide increased structural stability of a building incorporating the supporting structures. As shown in FIGS. 14, 15, 17 and 18, various brackets 124*g*, 124*h*, 124*i*, and 124*j* are provided to match the mutual angle of bands of material being interconnected.

Figure 19:
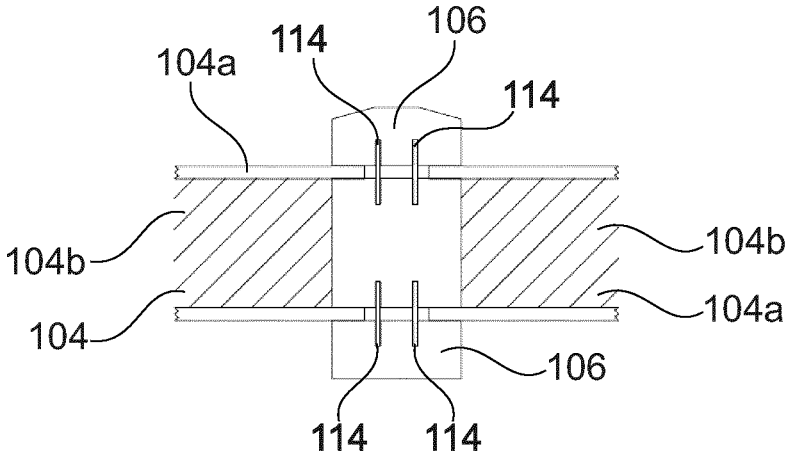
FIG. 19 shows a cross-section of an embodiment of a building structure according to the invention in the form wall or roof partition.
Figure 20:
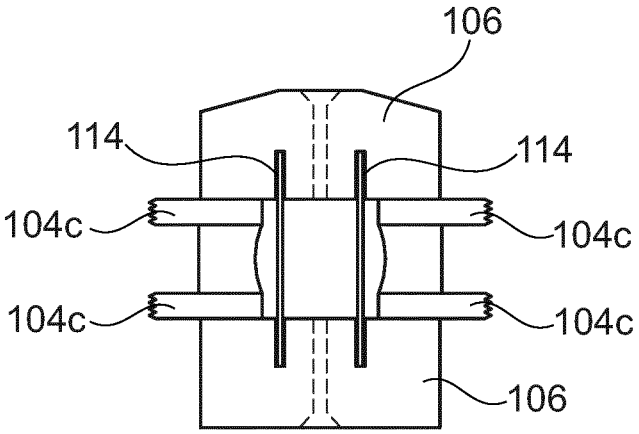
FIG. 20 shows a cross-section of an embodiment of a building structure according to the invention in the form of a double-glazed window section.

As shown in FIG. 19, a wall or roof panel 104 may comprise an outer shell 104*a* and a core 104*b* of, e.g., an insulating material. In the embodiment of FIG. 20, the wall or roof partition 104 comprises a double glazed window section 104*c*.

The invention claimed is:

1. A supporting structure for a wall or a roof partition, comprising:

an internal core structure extending in a longitudinal direction;

first and second external covering profiles extending in the longitudinal direction for at least partially covering the internal core structure, each of the first and second external covering profiles defining inwardly facing surfaces facing one another;

wherein the internal core structure extends between and engages into respective slits in the inwardly facing surfaces of the first and second external covering profiles;

the internal core structure comprises at least two bands of material which are mutually offset in a direction perpendicular to the longitudinal direction, wherein each of the at least two bands of material defines respective end portions at each of the at least two bands of material opposite ends when seen in the longitudinal direction;

the at least two bands of material are interconnected only at said at least two bands of material end portions;

the supporting structure further comprises bracket structures for pre-tensioning the at least two bands of material in the longitudinal direction, the bracket structures attaching to the opposite ends of each of the at least two bands of material and interconnecting the at least two bands of material;

each one of the bracket structures extends beyond the respective end portions of the at least two bands of material in the longitudinal direction.

2. The supporting structure according to claim 1, wherein each of the at least two bands of material comprises of a solid piece of material.

3. The supporting structure according to claim 1, comprising a biasing structure for biasing the first and second external covering profiles towards one another.

4. The supporting structure according to claim 1, wherein each of the at least two bands of material, when seen in a cross section perpendicular to the longitudinal direction, extends by a first dimension in one direction and by a second dimension in a second direction, which is perpendicular to the first direction, and wherein the first dimension is at least three times the second dimension, and wherein the first dimension is transverse to the inwardly facing surfaces of the covering profiles.

5. The supporting structure according to claim 4, wherein the first dimension is perpendicular to the inwardly facing surfaces of the covering profiles.

6. The supporting structure according to claim 1, wherein the at least two bands of material are made from a non-metallic material or from a composite component.

7. The supporting structure according to claim 6, wherein the at least two bands of material have a thermal conductivity of at most 5 W/mK at 20° C.

8. The supporting structure according to claim 6, wherein the composite component is non-metallic.

9. A building structure comprising a wall or roof partition and at least one supporting structure for supporting the wall or roof partition, the at least one supporting structure comprising:

an internal core structure extending in a longitudinal direction;

first and second external covering profiles extending in the longitudinal direction for at least partially covering the internal core structure, each of the first and second external covering profiles defining inwardly facing surfaces facing one another;

wherein the internal core structure extends between and engages into respective slits in the inwardly facing surfaces of the first and second external covering profiles;

wherein, the internal core structure comprises at least two bands of material which are mutually offset in a direction perpendicular to the longitudinal direction, wherein each of the at least two bands of material defines respective end portions at each of the at least two bands of material opposite ends when seen in the longitudinal direction;

the at least two bands of material are interconnected only at the at least two bands of material end portions;

the supporting structure further comprises bracket structures for pre-tensioning the at least two bands of material in the longitudinal direction, the bracket structures attaching to the opposite ends of each of the at least two bands of material and interconnecting the at least two bands of material;

each one of the bracket structures extends beyond the respective end portions of the at least two bands of material in the longitudinal direction.

10. The building structure according to claim 9, wherein the at least one supporting structure comprises at least two such supporting structures providing a ground-to-ground tensioning system extending from at least two ground attachment points through the at least two supporting structures.

11. The building structure according to claim 10, wherein the at least two supporting structures comprise at least two upright supporting structures and at least one transversely extending supporting structure, and wherein the bands of material of the at least two upright structures and the transversely extending structure are pre-tensioned and mutually interconnected by the bracket structures.

12. The building structure according to claim 9, wherein the at least one supporting structure comprises at least two supporting structures, and wherein the bracket structure attaches to the at least two bands of material of each of the at least two supporting structures.

13. The building structure according to claim 12, wherein the at least one supporting structure comprises at least two such supporting structures providing a ground-to-ground tensioning system extending from at least two ground attachment points through the at least two supporting structures.

14. The building structure according to claim 12, wherein the longitudinal direction of a first one of the at least two supporting structures extends at an angle relative to the longitudinal direction of a second one of the at least two supporting structures, and wherein the angle is defined by the bracket structure.

15. The building structure according to claim 12, wherein the at least two bands of material of each respective one of the at least two supporting structures are interconnected by a cross element of the bracket structure.

16. The building structure according to claim 12, comprising at least three supporting structures, a first one of which extends transversely to the other two, and wherein the bracket structure attaching to said other two supporting structures extends through an opening formed in the bands of the first supporting structure.

17. The building structure according to claim 16, wherein a first one of the supporting structures extends in a vertical column of a wall partition of the building structure, and wherein the longitudinal direction of the first supporting structure extends vertically, and wherein two other ones of the supporting structures extend in a roof partition of the building structure, and wherein the longitudinal direction of said other ones of the supporting structure extends horizontally or at an acute angle relative to the vertical direction.

18. The building structure according to claim 12, comprising at least three supporting structures, a first one of which extends transversely to the other two, and wherein the bracket structure is arranged in the vicinity of the ends of three of the supporting structures to provide a tensioning force to said at least three supporting structures in at least two directions.

19. The building structure according to claim 18, wherein a first one of the supporting structures extends in a vertical column of a wall partition of the building structure, and wherein the longitudinal direction of the first supporting structure extends vertically, and wherein two other ones of the supporting structures extend in a roof partition of the building structure, and wherein the longitudinal direction of said other ones of the supporting structure extends horizontally or at an acute angle relative to the vertical direction.

* * * * *